US010265946B2

(12) United States Patent
Ito et al.

(10) Patent No.: US 10,265,946 B2
(45) Date of Patent: Apr. 23, 2019

(54) PRINTING APPARATUS

(71) Applicant: KOMORI CORPORATION, Tokyo (JP)

(72) Inventors: Masaharu Ito, Ibaraki (JP); Hiroyuki Suda, Yamagata (JP)

(73) Assignee: KOMORI CORPORATION, Tokyo (JP)

( * ) Notice: Subject to any disclaimer, the term of this patent is extended or adjusted under 35 U.S.C. 154(b) by 0 days.

(21) Appl. No.: 15/740,296

(22) PCT Filed: Jun. 20, 2016

(86) PCT No.: PCT/JP2016/068232

§ 371 (c)(1),
(2) Date: Dec. 27, 2017

(87) PCT Pub. No.: WO2017/002647

PCT Pub. Date: Jan. 5, 2017

(65) Prior Publication Data

US 2018/0186148 A1 Jul. 5, 2018

(30) Foreign Application Priority Data

Jun. 30, 2015 (JP) ..... 2015-130744
Jun. 30, 2015 (JP) ..... 2015-130745

(51) Int. Cl.
*B41J 2/005* (2006.01)
*B41J 29/377* (2006.01)
(Continued)

(52) U.S. Cl.
CPC ..... *B41J 2/0057* (2013.01); *B41J 2/01* (2013.01); *B41J 2/04563* (2013.01);
(Continued)

(58) Field of Classification Search
CPC .. B41J 2/0057; B41J 2/04563; B41J 2/17593; B41J 2/3358; B41J 29/377; B41J 11/002; B41J 11/009
(Continued)

(56) References Cited

U.S. PATENT DOCUMENTS

2009/0225144 A1* 9/2009 Kusunoki ..... B41J 2/14233 347/102
2011/0069104 A1 3/2011 Tsuzawa
(Continued)

FOREIGN PATENT DOCUMENTS

CN 103249568 A 8/2013
CN 103373084 A 10/2013
(Continued)

OTHER PUBLICATIONS

Office Action received for Japanese Patent Application No. 2017-526290, dated Nov. 16, 2018, 6 pages (3 pages of English Translation and 3 pages of Office Action).
(Continued)

*Primary Examiner* — Huan Tran
*Assistant Examiner* — Alexander D Shenderov
(74) *Attorney, Agent, or Firm* — Womble Bond Dickinson (US) LLP

(57) ABSTRACT

A printing apparatus includes a printing cylinder (17) that holds and transfers a sheet (4), a supply-side transfer cylinder (16 (sheet supply unit)) that supplies the sheet (4) to the printing cylinder (17) at a supply position (P1), and first to fourth inkjet heads (27-30). The printing apparatus includes a transfer mechanism (18) that receives the sheet (4) after printing at a receiving position (P2) and transfers the sheet (4) to one of a discharge route (44) and a reversing route (42). The reversing route (42) employs an arrangement that returns the reversed sheet (4) to the printing cylinder
(Continued)

(17) at a return position (P3) located on the downstream side of the receiving position (P2) in the transfer direction of the sheet (4) and on the upstream side of the supply position (P1) in the transfer direction of the sheet (4). A cooling means (45) for cooling the transfer surface (24 (outer peripheral surface)) of the printing cylinder (17) is provided between the receiving position (P2) and the return position (P3). It is possible to provide the printing apparatus that suppresses an increase in the temperature of the transfer surface of the printing cylinder and always sets the temperature of the sheet at an appropriate temperature.

4 Claims, 8 Drawing Sheets

(51) Int. Cl.

| | |
|---|---|
| ***B41J 2/045*** | (2006.01) |
| ***B41J 2/175*** | (2006.01) |
| ***B41J 2/01*** | (2006.01) |
| *B41J 2/335* | (2006.01) |
| *B41J 11/00* | (2006.01) |

(52) U.S. Cl.
CPC ..... *B41J 2/17593* (2013.01); *B41J 29/377* (2013.01); *B41J 2/3358* (2013.01); *B41J 11/002* (2013.01); *B41J 11/009* (2013.01)

(58) Field of Classification Search
USPC ..... 347/206
See application file for complete search history.

(56) References Cited

U.S. PATENT DOCUMENTS

| | | | | |
|---|---|---|---|---|
| 2012/0069112 | A1 | 3/2012 | Wanibe | |
| 2013/0127962 | A1 | 5/2013 | Yoda | |
| 2013/0265359 | A1 | 10/2013 | Sugaya et al. | |
| 2013/0278668 | A1* | 10/2013 | Miyamoto | B41J 11/002 347/17 |
| 2013/0307893 | A1 | 11/2013 | Suda et al. | |
| 2013/0328983 | A1* | 12/2013 | Thayer | B41J 2/0057 347/103 |
| 2013/0328989 | A1* | 12/2013 | Thayer | B41J 2/17593 347/206 |
| 2015/0124029 | A1 | 5/2015 | Sugaya et al. | |

FOREIGN PATENT DOCUMENTS

| | | | |
|---|---|---|---|
| CN | 106240156 | A | 12/2016 |
| DE | 19745136 | A1 | 4/1998 |
| EP | 2123465 | A1 | 11/2009 |
| EP | 2650132 | A1 | 10/2013 |
| EP | 2657035 | A1 | 10/2013 |
| EP | 2845733 | A1 | 3/2015 |
| EP | 2965917 | A1 | 1/2016 |
| JP | H10-193580 | A | 7/1998 |
| JP | 2009-208350 | A | 9/2009 |
| JP | 2010-052143 | A | 3/2010 |
| JP | 2011-207111 | A | 10/2011 |
| JP | 2012-121288 | A | 6/2012 |
| JP | 2013-107275 | A | 6/2013 |
| JP | 2013-240989 | A | 12/2013 |
| JP | 2013-256115 | A | 12/2013 |
| WO | WO 2012/077736 | A1 | 6/2012 |
| WO | 2013/076906 | A1 | 5/2013 |
| WO | WO 2013/165003 | A1 | 11/2013 |
| WO | 2014/136512 | A1 | 9/2014 |
| WO | 2015/060060 | A1 | 4/2015 |

OTHER PUBLICATIONS

"International Search Report," PCT Application No. PCT/JP2016/068232 (dated Sep. 6, 2016).
"International Preliminary Report on Patentability," PCT Application No. PCT/JP2016/068232 (dated Jan. 2, 2018).
Written Opinion received for PCT Patent Application No. PCT/JP2016/068232, dated Sep. 6, 2016, 14 pages (9 pages of English Translation and 5 pages of Original Document).
Office Action received for Chinese Patent Application No. 201680038449.4, dated Oct. 26, 2018, 10 pages (5 pages of English Translation and 5 pages of Office Action).
Supplementary European Search Report and Written Opinion received for EP Patent Application No. 16817755.8, dated Jan. 18, 2019, 20 pages.

* cited by examiner

PRINTING APPARATUS

TECHNICAL FIELD

The present invention relates to a printing apparatus including a printing cylinder configured to hold and transfer a sheet, and an inkjet head.

BACKGROUND ART

As a conventional printing apparatus, there exists a digital printing apparatus that performs printing by causing an inkjet head to discharge ink to a sheet held on the outer peripheral surface of a printing cylinder, as described in, for example, patent literature 1. The digital printing apparatus disclosed in patent literature 1 includes a first heater configured to heat a sheet before printing, and a second heater configured to heat the printing cylinder after printing. In the digital printing apparatus, the temperature of the sheet is controlled to a predetermined temperature using the first and second heaters. Printing is performed in a state in which the temperature of the sheet is raised to the predetermined temperature.

The digital printing apparatus includes a drying device that dries ink after printing. The drying device irradiates the sheet after printing with infrared rays or ultraviolet rays. The ink is dried by the heat energy of the infrared rays or ultraviolet rays with which the ink is irradiated.

RELATED ART LITERATURE

Patent Literature

Patent Literature 1: International Publication No. 2013/165003

DISCLOSURE OF INVENTION

Problem to be Solved by the Invention

In the conventional digital printing apparatus described in patent literature 1, the transfer surface (outer peripheral surface) of the printing cylinder is unnecessarily heated, and the increase in the temperature of the printing cylinder makes the surface temperature of the sheet excessively high. If the surface temperature of the sheet excessively rises, the viscosity of ink changes, and the image quality degrades.

There are two main causes of the increase in the temperature of the transfer surface of the printing cylinder, as will be described below.

As the first cause, the infrared rays or ultraviolet rays used to dry the ink heat the transfer surface of the printing cylinder.

As the second cause, the ink causes a chemical reaction and generates heat when it is dried (solidified) by the drying device. The heat of the ink is transmitted to the printing cylinder via the sheet. That is, when the sheet passes the position where the sheet faces the drying device and is then held and transferred by the printing cylinder, the heat of the ink is transmitted to the transfer surface of the printing cylinder via the sheet. For this reason, the temperature of the transfer surface rises, as described above.

The present invention has been made to solve the above-described problem, and has as its object to provide a printing apparatus that suppresses the rise of the temperature of the transfer surface of a printing cylinder and always sets the temperature of a sheet at an appropriate temperature.

Means of Solution to the Problem

In order to achieve the object, according to the present invention, there is provided a printing apparatus comprising a printing cylinder which holds a sheet on an outer peripheral surface and rotationally transfers the sheet in a predetermined direction, sheet supply means for supplying the sheet to the printing cylinder at a predetermined supply position, a printhead which discharges ink toward the sheet held by the printing cylinder and performs printing on the sheet, and a transfer mechanism which receives the sheet after the printing at a receiving position located on a downstream side of the printhead in a sheet transfer direction and transfers the sheet to one of a discharge route through which the sheet is discharged and a reversing route through which the sheet is reversed, wherein the transfer mechanism employs an arrangement which returns the sheet, which is sent to the reversing route and reversed, to the printing cylinder at a return position located on the downstream side of the receiving position in the sheet transfer direction and on an upstream side of the supply position in the sheet transfer direction, and cooling means for cooling the outer peripheral surface of the printing cylinder is provided between the receiving position and the return position.

According to the present invention, there is also provided a printing apparatus comprising a printing cylinder which holds a sheet on an outer peripheral surface and rotationally transfers the sheet in a predetermined direction, a printhead which discharges ink toward the sheet held by the printing cylinder and performs printing on the sheet, a discharge cylinder to which the sheet printed by the printhead and transferred by the printing cylinder is handed over and which holds the sheet on an outer peripheral surface and rotationally discharges the sheet in a predetermined direction, and a drying device located between the printhead and the discharge cylinder in a sheet transfer direction and arranged facing the printing cylinder, wherein a transfer distance between the printhead and the drying device is longer than a transfer distance between the drying device and the discharge cylinder.

Effect of the Invention

According to the invention including the cooling means of the present invention, the transfer surface (outer peripheral surface) of the printing cylinder is exposed between the receiving position and the return position and cooled by the cooling means. For this reason, since an increase in the temperature of the transfer surface of the printing cylinder is suppressed, the sheet is never heated by the printing cylinder. It is therefore possible to provide the printing apparatus that always sets the temperature of the sheet at an appropriate temperature.

In addition, according to the invention in which the transfer distance between the printhead and the drying device is longer than the transfer distance between the drying device and the discharge cylinder, the sheet is immediately handed over from the printing cylinder to the discharge cylinder after the ink drying processing. The ink generates heat by a chemical reaction at the time of drying. The heat of the ink is transmitted to the printing cylinder via the sheet. In the present invention, however, since the time in which the sheet is held by the printing cylinder after the drying of the ink is short, the heat generated in association with the ink drying processing is hardly transmitted to the printing cylinder. For this reason, since an increase in the temperature of the transfer surface of the printing cylinder is suppressed, the sheet is never heated by the printing cylinder. It is therefore possible to provide the printing apparatus that always sets the temperature of the sheet at an appropriate temperature.

BEST MODE FOR CARRYING OUT THE INVENTION

First Embodiment (Explanation of Schematic Arrangement)

The schematic arrangement of a printing apparatus according to the present invention will now be described in detail with reference to FIGS. 1 and 2.

Figure 1:
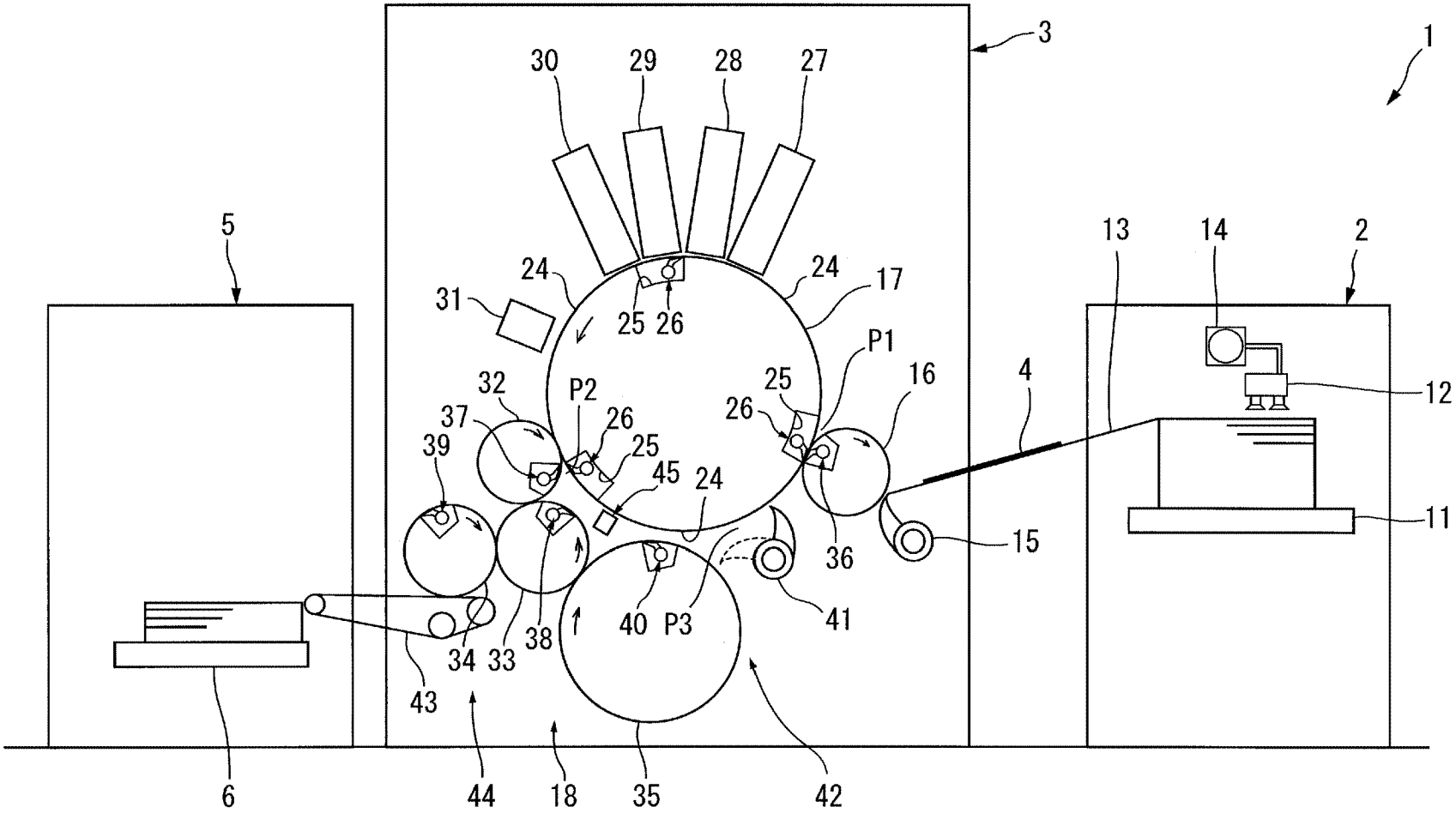
FIG. 1 is a side view showing the schematic arrangement of a printing apparatus according to the first embodiment of the present invention.
Figure 2:
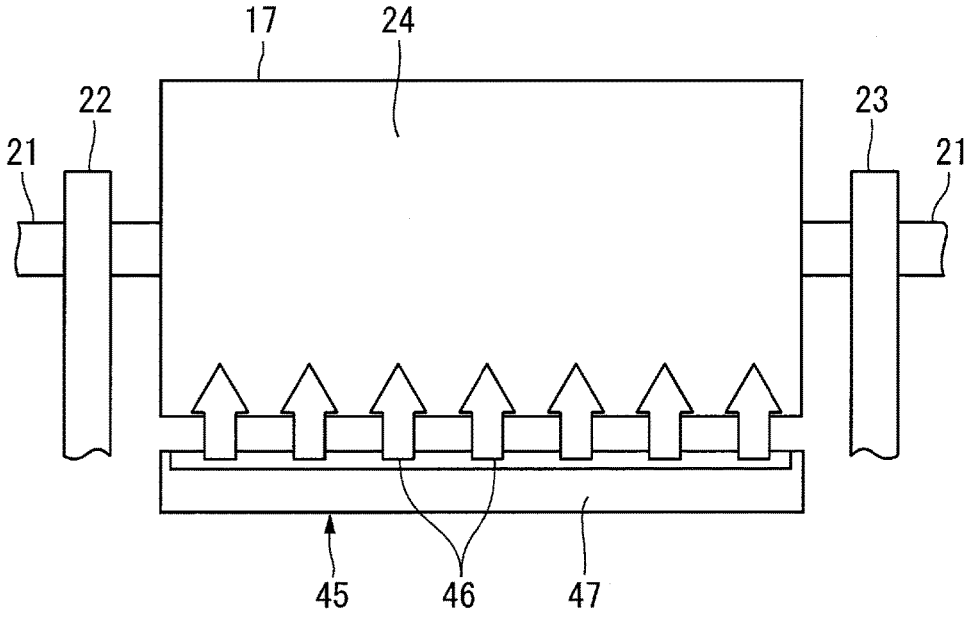
FIG. 2 is a front view showing the schematic arrangement of a printing cylinder and a cooling means.

A printing apparatus 1 shown in FIG. 1 transfers a sheet 4 from a feeder unit 2 located at the rightmost position in FIG. 1 to a printing unit 3 and causes the printing unit 3 to perform printing on one or both surfaces of the sheet 4. The sheet 4 printed by the printing unit 3 is sent to a delivery unit 5 and discharged to a delivery pile 6.

The feeder unit 2 has a structure to transfer the sheet 4 from a feeder pile 11 to a feeder board 13 by a sucker 12. The sucker 12 is connected to an intermittent feeding valve 14 and operates in one of a mode in which the sheet 4 is continuously fed and a mode in which the sheet 4 is intermittently fed. When printing only the obverse surface of the sheet 4, the sucker 12 continuously feeds the sheet 4 to the feeder board 13. On the other hand, when printing the obverse and reverse surfaces of the sheet 4, the sucker 12 intermittently feeds the sheet 4 to the feeder board 13.

The printing unit 3 includes a supply-side transfer cylinder 16 to which the sheet 4 supplied from the feeder unit 2 is transferred by a sheet supply-side swing arm shaft pre-gripper 15, a printing cylinder 17 to which the sheet 4 is fed from the supply-side transfer cylinder 16, and a transfer mechanism 18 that sends the sheet 4 after printing.

The supply-side transfer cylinder 16 supplies the sheet 4 to the printing cylinder 17 at a supply position P1. In this embodiment, the supply-side transfer cylinder 16 constitutes "sheet supply means" in the present invention.

The supply-side transfer cylinder 16 also includes a heater (not shown) that heats the sheet 4 to a predetermined temperature. Note that the printing unit 3 according to this embodiment includes a heater (not shown) that heats a transfer surface 24 of the printing cylinder 17 to a temperature that allows printing at the start of an operation. As this heater, the same heater as that described in patent literature 1 can be used.

The printing cylinder 17 sucks and transfers the sheet 4. As shown in FIG. 2, the printing cylinder 17 includes a shaft 21 projecting from both ends in the axial direction (the horizontal direction in FIG. 2), and is rotatably supported by a pair of frames 22 and 23 via the shaft 21. The printing cylinder 17 according to this embodiment is called a three-fold cylinder, and includes the transfer surfaces 24 at three portions in the rotating direction, as shown in FIG. 1. The transfer surfaces 24 are formed by the outer peripheral surface of the printing cylinder 17, and are provided at positions to equally divide the printing cylinder 17 into three parts when viewed from the axial direction. An outer peripheral notch portion 25 is provided between the transfer surfaces 24 adjacent to each other. A gripper device 26 is also provided between the transfer surfaces 24. The gripper device 26 grips and holds an end of the sheet 4 on the downstream side in the transfer direction.

First to fourth inkjet heads 27 to 30 and an ink drying lamp 31 are arranged in this order near the periphery of the printing cylinder 17 on the downstream side of the supply-side transfer cylinder 16 in the sheet transfer direction.

The first to fourth inkjet heads 27 to 30 perform printing by discharging ink droplets to the sheet 4. In this embodiment, the first to fourth inkjet heads 27 to 30 from "print-head" in the present invention. Each of the first to fourth inkjet heads 27 to 30 includes a plurality of nozzles (not shown) arranged in the axial direction of the printing cylinder 17. In addition, each of the first to fourth inkjet heads 27 to 30 includes a heater (not shown) that heats ink to a predetermined temperature for the purpose of correctly adhering ink droplets to the sheet 4.

The ink drying lamp 31 is configured to cure the ink applied to the sheet 4 by the first to fourth inkjet heads 27 to 30. The ink drying lamp 31 irradiates the sheet 4 with infrared rays or ultraviolet rays. When the ink is irradiated with the infrared rays or ultraviolet rays, the temperature of the ink rises, and the ink dries (solidifies).

The above-described transfer mechanism 18 is formed using a plurality of transport cylinders. The plurality of transport cylinders are a first discharge-side transfer cylinder 32 that receives the sheet 4 from the printing cylinder 17 at a receiving position P2, a second discharge-side transfer cylinder 33 that receives the sheet 4 from the first discharge-side transfer cylinder 32, and a third discharge-side transfer cylinder 34 and a pre-reversal double-diameter cylinder 35 each of which receives the sheet 4 from the second discharge-side transfer cylinder 33. The transfer mechanism 18 receives the sheet 4 at the receiving position P2 located on the downstream side of the first to fourth inkjet heads 27 to 30 in the sheet transfer direction.

The above-described supply-side transfer cylinder 16, first discharge-side transfer cylinder 32, second discharge-side transfer cylinder 33, third discharge-side transfer cylinder 34, and pre-reversal double-diameter cylinder 35 include gripper devices 36 to 40, respectively, to hand over the sheet 4. The gripper devices 36 to 40 are the same as the gripper device 26 of the printing cylinder 17.

Of the sheets 4 that the first discharge-side transfer cylinder 32 has received at the receiving position P2, the sheet 4 whose reverse surface undergoes printing passes through a reversing route 42 formed by the second discharge-side transfer cylinder 33, the pre-reversal double-diameter cylinder 35, and a reversing swing arm shaft pregripper 41 to be described later and is returned to the printing cylinder 17 in a reversed state.

On the other hand, the sheet 4 whose obverse surface undergoes printing alone or the sheet 4 that has undergone printing on both the obverse and reverse surfaces passes through a discharge route 44 formed by the second discharge-side transfer cylinder 33, the third discharge-side transfer cylinder 34, and a delivery belt 43 and is discharged to the delivery pile 6. Hence, the transfer mechanism 18 transfers the sheet 4 to one of the discharge route 44 through which the sheet 4 is discharged and the reversing route 42 through which the sheet 4 is reversed.

The reversing swing arm shaft pregripper 41 is configured to feed the sheet 4 from the pre-reversal double-diameter cylinder 35 to the printing cylinder 17 and arranged between the pre-reversal double-diameter cylinder 35 and the supply-side transfer cylinder 16. The reversing swing arm shaft pregripper 41 grips an end of the sheet 4, which is fed by the pre-reversal double-diameter cylinder 35, on the upstream side in the transfer direction, and returns the sheet 4 to the printing cylinder 17 in a state in which the obverse surface of the sheet 4 faces the printing cylinder 17 (in a reversed state). The position at which the reversing swing arm shaft pregripper 41 returns the sheet 4 to the printing cylinder 17 will be referred to as a "return position P3" hereinafter.

As described above, the transfer mechanism 18 employs an arrangement that returns the sheet 4 fed to the reversing route 42 and reversed to the printing cylinder 17 at the return position P3 located on the downstream side of the receiving position P2 in the sheet transfer direction and on the upstream side of the supply position P1 in the sheet transfer direction.

A cooling means 45 is provided near the periphery of the printing cylinder 17 between the receiving position P2 and the return position P3 described above. The cooling means 45 cools the transfer surface 24 (outer peripheral surface) of the printing cylinder 17. The cooling means 45 according to this embodiment is formed from a fan 47 that blows cooling air 46 to the transfer surface 24, as shown in FIG. 2. The fan 47 is formed into a shape long in a direction parallel to the axial direction of the printing cylinder 17, and blows the cooling air 46 to an overall region from one end to the other end of the transfer surface 24 in the axial direction of the printing cylinder 17.

In the thus configured printing apparatus 1, the sheet 4 is transferred by the printing cylinder 17 in a state in which the sheet 4 is heated to a predetermined temperature, and passes positions where the sheet faces the first to fourth inkjet heads 27 to 30. When the sheet 4 faces each of the first to fourth inkjet heads 27 to 30, ink droplets are discharged from the inkjet head to the sheet 4, and printing is performed on the sheet 4. The ink adhered to the sheet 4 is dried (solidified) as the sheet 4 passing the position where it faces the ink drying lamp 31 is irradiated with infrared rays or ultraviolet rays.

The temperature of the sheet 4 is raised by the heat of the supply-side transfer cylinder 16, the heat of the ink, and the like. The heat of the sheet 4 is transmitted to the transfer surface 24 of the printing cylinder 17 during transfer. Note that the temperature of the transfer surface 24 is raised not only by the heat transmitted from the sheet 4 but also when the heat of a heat source other than the sheet 4 is directly applied to the transfer surface 24. As the heat of the heat source other than the sheet 4, there are radiant heat generated by the supply-side transfer cylinder 16 or the first to fourth inkjet heads 27 to 30 and heat generated when the ink drying lamp 31 emits infrared rays or ultraviolet rays.

Since the heat is applied to the transfer surface 24 in this way, the temperature of the transfer surface 24 is highest when the sheet 4 passes the position where the sheet faces the ink drying lamp 31.

The sheet 4 after the ink has dried is transferred from the printing cylinder 17 to the first discharge-side transfer cylinder 32 at the receiving position P2, and when the reverse surface is to be printed, returned from the reversing swing arm shaft pregripper 41 to the printing cylinder 17 again. For this reason, the transfer surface 24 of the printing cylinder 17 is exposed when the sheet passes between the receiving position P2 where the first discharge-side transfer cylinder 32 receives the sheet 4 from the printing cylinder 17 and the return position P3 where the reversing swing arm shaft pregripper 41 returns the sheet 4 to the printing cylinder 17.

The cooling means 45 is provided between the receiving position P2 and the return position P3. The cooling means 45 blows the cooling air 46 to the transfer surface 24. For this reason, the temperature of the transfer surface 24 lowers as the transfer surface 24 is air-cooled by the cooling air 46 blown to the transfer surface 24 between the receiving position P2 and the return position P3. As a result, even of the printing cylinder 17 continuously transfers the sheet 4, the temperature of the transfer surface 24 never becomes too high.

If the increase in the temperature of the transfer surface 24 is suppressed, the sheet 4 is not excessively heated by the printing cylinder 17.

Hence, according to this embodiment, it is possible to provide the printing apparatus that always sets the temperature of the sheet 4 at an appropriate temperature.

The cooling means 45 according to this embodiment is formed by the fan 47 that blows the cooling air 46 to the transfer surface 24 (outer peripheral surface) of the printing cylinder 17.

For this reason, the capability of cooling the transfer surface 24 can easily be changed by changing the volume, direction, temperature, and the like of the cooling air 46. Hence, since optimum cooling according to the operation state of the printing apparatus 1 can be performed, it is possible to provide the printing apparatus that stabilizes the quality of a printing product.

(Detailed Example of First Embodiment)

Figure 3:
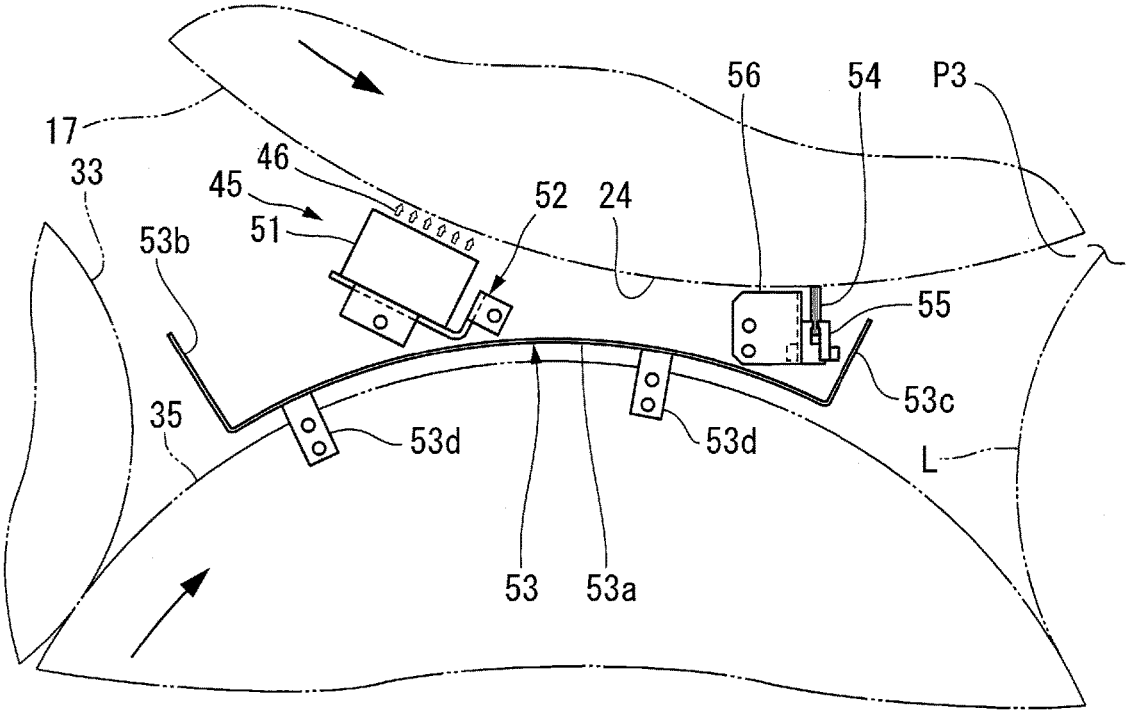
FIG. 3 is a side view showing a detailed example of main parts of the printing apparatus according to the present invention.
Figure 4:
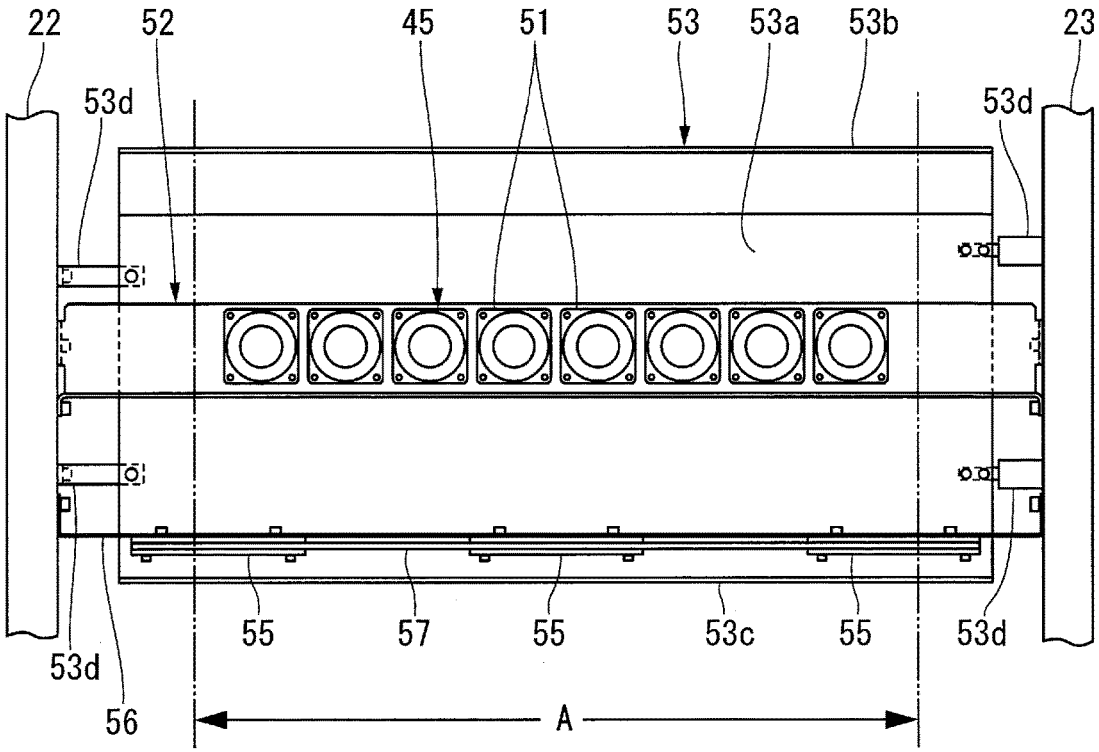
FIG. 4 is a plan view of the cooling means viewed from the side of the printing cylinder.

The cooling means 45 can be configured as shown in FIGS. 3 and 4. Members that are the same as or similar to those described with reference to FIGS. 1 and 2 are denoted by the same reference numerals in FIGS. 3 and 4, and a detailed description thereof will appropriately be omitted.

The cooling means 45 shown in FIGS. 3 and 4 is formed by a plurality of fans 51 provided between the receiving position P2 and the return position P3. The fans 51 are held by a bracket 52 (to be described later) in a state in which the cooling air 46 blows toward the printing cylinder 17. The fans 51 are arranged in the axial direction (the horizontal direction in FIG. 4) of the printing cylinder 17 so as to be located in an entire predetermined placing range A, as shown in FIG. 4. The placing range A corresponds to the maximum range capable of holding the sheet 4 on the transfer surface 24 of the printing cylinder 17.

The support bracket 52 is formed to have an L-shaped cross-section and extend in the axial direction (the horizontal direction in FIG. 4) of the printing cylinder 17, and supported at two ends by the frames 22 and 23. In this embodiment, as shown in FIG. 3, a guide plate 53 and a wind screen brush 54 are provided near the fans 51. The guide plate 53 is formed into a shape conforming to the pre-reversal double-diameter cylinder 35, as will be described later in detail. The wind screen brush 54 is arranged between the fans 51 and the return position P3.

The guide plate 53 is configured to prevent the sheet 4 transferred by the pre-reversal double-diameter cylinder 35 from coming into contact with the fans 51 or the wind screen brush 54 and being damaged. In addition, the guide plate 53 regulates the flow of the cooling air 46 that has hit the printing cylinder 17 to the side of the pre-reversal double-diameter cylinder 35. Hence, the behavior of the sheet 4 transferred by the pre-reversal double-diameter cylinder 35 is not disturbed by the cooling air 46.

The guide plate 53 is formed by a curved portion 53*a* conforming to the pre-reversal double-diameter cylinder 35, and an upstream-side vertical wall 53*b* and a downstream-side vertical wall 53*c* which extend from the two ends of the curved portion 53*a* in directions opposite to the pre-reversal double-diameter cylinder 35, and attached to the frames 22 and 23 by a plurality of stays 53*d* connected to the two ends of the curved portion 53*a*.

The curved portion 53*a* is located between the fans 51 and the pre-reversal double-diameter cylinder 35 and covers part of the pre-reversal double-diameter cylinder 35 from the outside in the radial direction. The upstream-side vertical wall 53*b* is located on the upstream side of the fans 51 in the sheet transfer direction and extends in the radial direction of the pre-reversal double-diameter cylinder 35 between the fans 51 and the second discharge-side transfer cylinder 33. The downstream-side vertical wall 53*c* is located on the downstream side of the fans 51 in the sheet transfer direction and extends in the radial direction of the pre-reversal double-diameter cylinder 35 between the fans 51 and a moving locus L of the reversing swing arm shaft pregripper 41.

The wind screen brush 54 blocks the cooling air 46 flowing to the side of the reversing swing arm shaft pregripper 41, and extends from a position close to one frame 22 to a position close to the other frame 23 in the axial direction of the printing cylinder 17, as shown in FIG. 4.

In addition, the wind screen brush 54 is arranged near the downstream-side vertical wall 53*c* of the guide plate 53 and on the upstream side of the downstream-side vertical wall 53*c* in the sheet transfer direction. The wind screen brush 54 has a structure in which a number of bristles (not shown) extending in the radial direction of the printing cylinder 17 are arranged in the axial direction of the printing cylinder 17. The wind screen brush 54 is attached to the subframes 22 and 23 by a brush bracket 56 with a plurality of holders 55 in a state in which the ends of the bristles are located near the transfer surface 24 of the printing cylinder 17. The holders 55 clamp and hold an end of the wind screen brush 54 on the opposite side of the printing cylinder 17.

In this embodiment, the cooling air 46 blown from the plurality of fans 51 hits the transfer surface 24 of the printing cylinder 17, thereby cooling the transfer surface 24. For this reason, even if this embodiment is employed, the same effect as in the embodiment shown in FIGS. 1 and 2 can be obtained. According to this embodiment, the guide plate 53 is provided between the fans 51 and the wind screen brush 54 and the pre-reversal double-diameter cylinder 35. For this reason, even if part of the sheet 4 transferred by the pre-reversal double-diameter cylinder 35 is separated from the pre-reversal double-diameter cylinder 35, it does not come into contact with the fans 51 or the wind screen brush 54 (bracket 56). For this reason, the sheet 4 can be protected by the guide plate 53.

The fans 51 are provided at a position close to the printing cylinder 17 to obtain high cooling performance. For this reason, the cooling air 46 that has hit the printing cylinder 17 may be blown back to the side of the pre-reversal double-diameter cylinder 35.

Of the cooling air 46, the cooling air 46 flowing toward the pre-reversal double-diameter cylinder 35 hits the guide plate 53 and then flows along the guide plate 53. The guide plate 53 is formed into a groove shape extending in the axial direction of the printing cylinder 17. For this reason, the cooling air flowing along the guide plate 53 is discharged to both sides in the axial direction of the printing cylinder 17.

On the other hand, the cooling air 46 that has hit the printing cylinder 17 and flowed to the downstream side in the transfer direction hits the downstream-side vertical wall 53*c* of the guide plate 53 and the wind screen brush 54. For this reason, since flowing of the cooling air 46 to the side of the reversing swing arm shaft pregripper 41 is regulated, the behavior of the sheet 4 transferred from the pre-reversal double-diameter cylinder 35 to the printing cylinder 17 by the reversing swing arm shaft pregripper 41 stabilizes.

For this reason, according to this embodiment, since the cooling air 46 is never blown to the sheet 4 transferred by the pre-reversal double-diameter cylinder 35 or the reversing swing arm shaft pregripper 41, a large quantity of cooling air 46 can be blown to the printing cylinder 17 by the fans 51, and the cooling performance can be improved.

Second Embodiment

Figure 5:
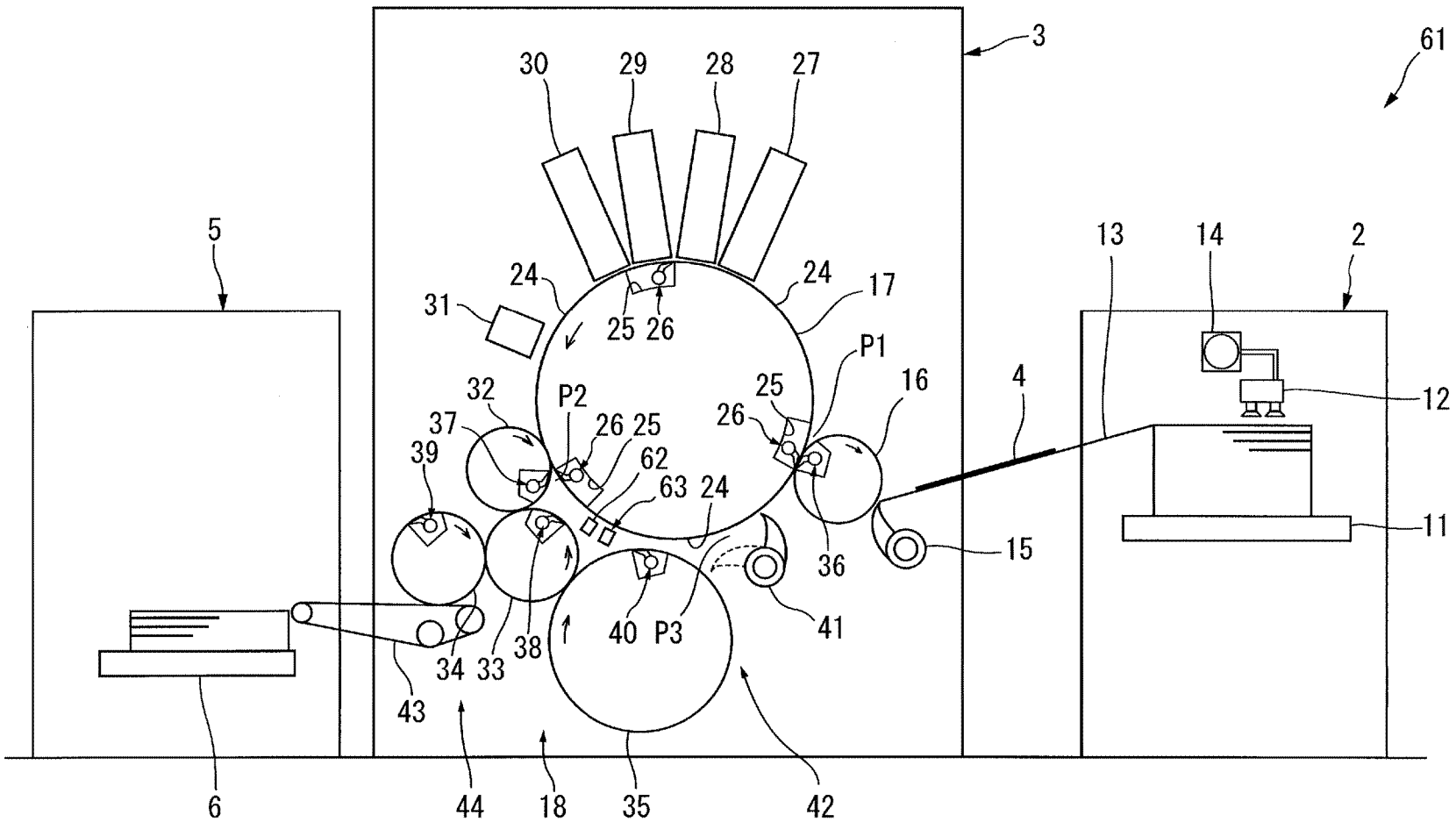
FIG. 5 is a side view showing the schematic arrangement of a printing apparatus according to the second embodiment of the present invention.
Figure 6:
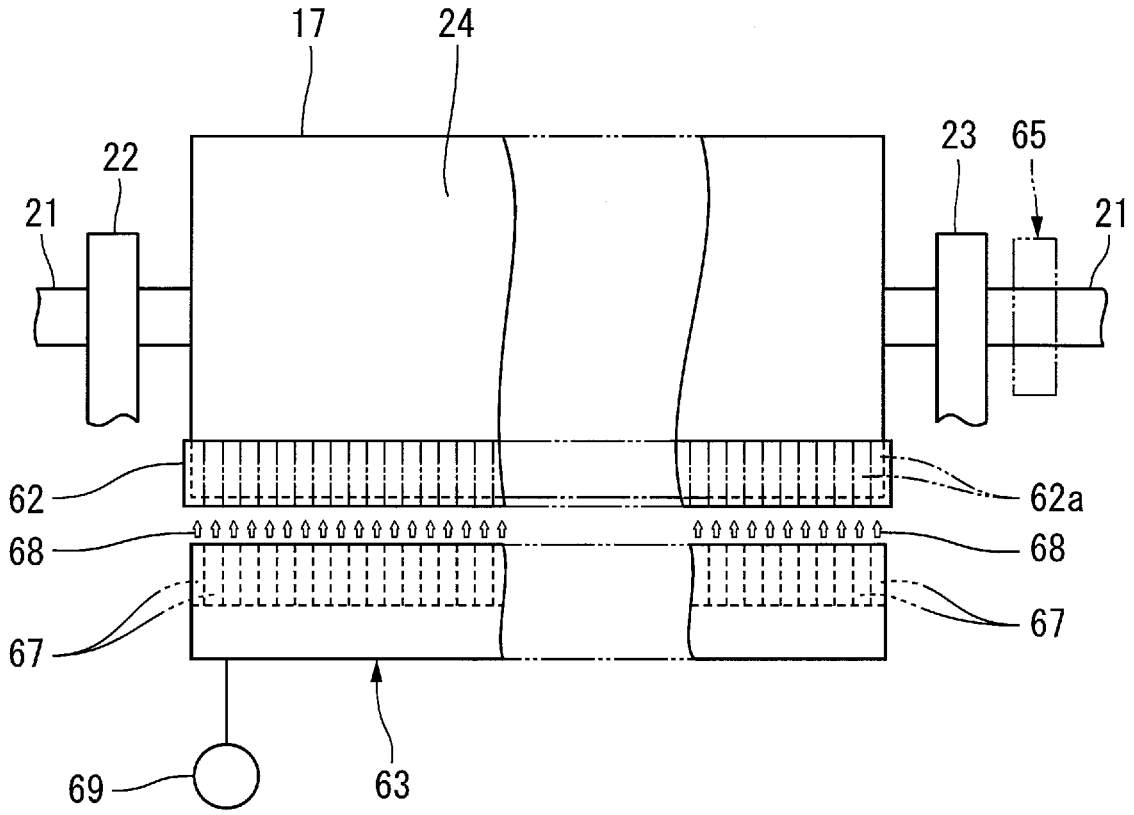
FIG. 6 is a front view showing the schematic arrangement of a printing cylinder, a hot portion detection means, and a cooling means.
Figure 7:
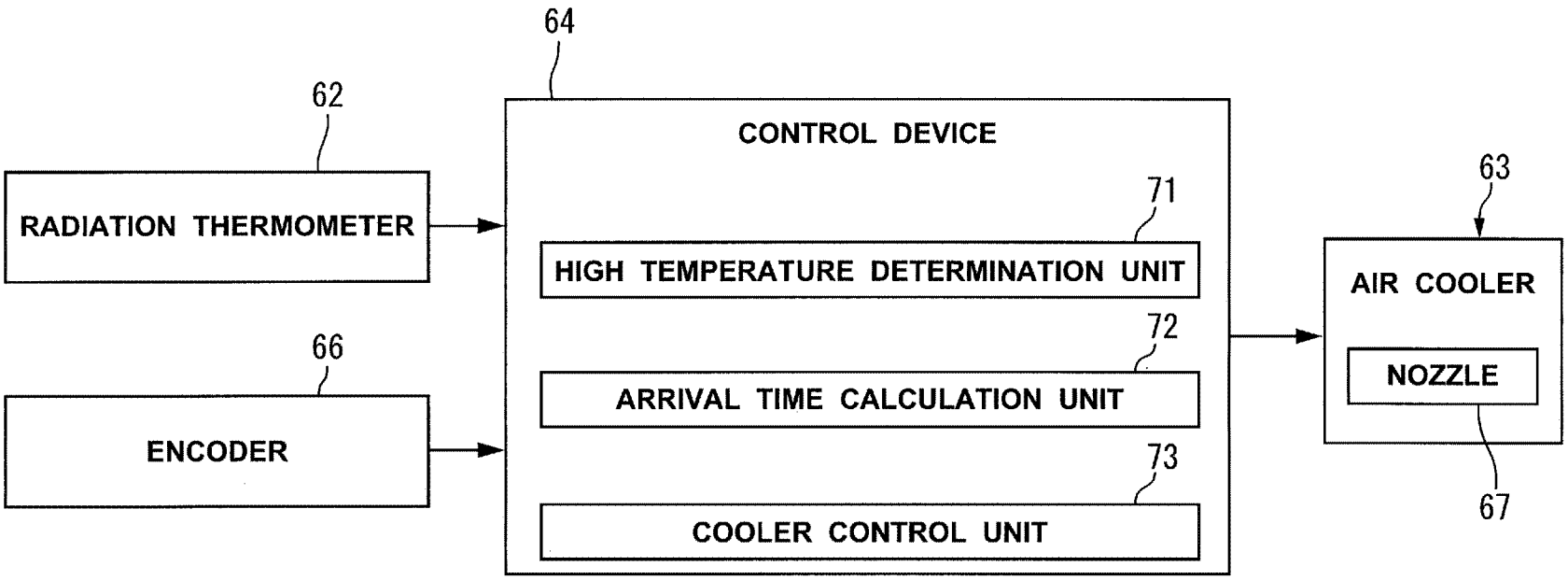
FIG. 7 is a block diagram showing the arrangement of a control system.

The printing apparatus according to the present invention can be configured as shown in FIGS. 5 to 7. Members that are the same as or similar to those described with reference to FIGS. 1 to 4 are denoted by the same reference numerals in FIGS. 5 to 7, and a detailed description thereof will appropriately be omitted.

In a printing apparatus 61 shown in FIG. 5, a radiation thermometer 62 and an air cooler 63 serving as a cooling means are provided between a receiving position P2 and a return position P3. The radiation thermometer 62 is located on the upstream side of the air cooler 63 in the sheet transfer direction, that is, on the upstream side of a printing cylinder 17 in the rotating direction. Note that the attachment position of the radiation thermometer 62 can be changed as long as it is located on the downstream side of a fourth inkjet head 30 in the sheet transfer direction, that is, on the downstream side of the printing cylinder 17 in the rotating direction.

The radiation thermometer 62 detects the temperature of a transfer surface 24 of the printing cylinder 17 in a noncontact state and sends it as temperature data to a control device 64 (see FIG. 7) to be described later.

The radiation thermometer 62 according to this embodiment includes a plurality of detection units 62*a* arranged in the axial direction of the printing cylinder 17, as shown in FIG. 6. The detection units 62*a* employ an arrangement capable of detecting the temperature from one end to the other end of the transfer surface 24 in the axial direction of the printing cylinder 17. Note that the radiation thermometer 62 is not limited to that shown in this embodiment. For example, the radiation thermometer 62 may be a radiation thermometer capable of measuring the temperature distribution in the axial direction of the printing cylinder 17 by one detection unit.

A transmission device 65 is connected to one end of a shaft 21 of the printing cylinder 17 shown in FIG. 6, although details are not illustrated. The transmission device 65 transmits the power of the motor (not shown) of this apparatus to the printing cylinder 17 or other cylinders (to be described later) in a transfer mechanism 18.

An encoder 66 (see FIG. 7) serving as a phase detection means for detecting the rotation phase of the printing cylinder 17 is provided at a portion that rotates integrally with the shaft 21.

The air cooler 63 cools the transfer surface (outer peripheral surface) of the printing cylinder 17. As shown in FIG. 6, the air cooler 63 according to this embodiment includes a plurality of nozzles 67 arranged in the axial direction of the printing cylinder 17. The plurality of nozzles 67 are provided at positions in the axial direction equal to the positions of the plurality of detection units 62*a* in the axial direction. However, this does not apply in a case in which one detection unit is provided. For example, the printing cylinder 17 is equally divided in the axial direction into sections as many as the nozzles 67, and a nozzle 67 is provided in each section. Each of the nozzles 67 ejects cooling air 68 and is directed to the transfer surface 24 of the printing cylinder 17.

In addition, the air cooler 63 is connected to an air source 69 and includes an on-off valve (not shown) for each nozzle, which opens/closes the air passage of each nozzle 67. When the on-off valve opens, the nozzle 67 is set in a cooling state, and compressed air is ejected from the nozzle 67 as the cooling air 68 and blown to the transfer surface 24. When the on-off valve closes, ejection of compressed air stops, and the nozzle 67 is set in a non-cooling state. That is, the nozzles 67 are configured to be switchable to one of the cooling state and the non-cooling state. The operation of each on-off valve is controlled by the control device 64 to be described later. In this embodiment, the nozzles 67 correspond to "cooling units" in the invention described in claim 3.

As shown in FIG. 7, the control device 64 includes a high temperature determination unit 71, an arrival time calculation unit 72, and a cooler control unit 73. The high temperature determination unit 71 compares the temperature of a detection target portion of the transfer surface 24 detected by each detection unit 62*a* of the radiation thermometer 62 with a predetermined allowable temperature, and if the temperature of the detection target portion exceeds the allowable temperature, stores the detection target portion as a hot portion. In this embodiment, the high temperature determination unit 71 and the radiation thermometer 62 constitute "hot portion detection means" in the invention described in claim 2. When the high temperature determination unit 71 and the radiation thermometer 62 are used, the temperature can individually be detected at each of a plurality of positions of the transfer surface 24 in the axial direction of the printing cylinder 17, and a hot portion can be detected.

The arrival time calculation unit 72 obtains, using the encoder 66, an arrival time at which the hot portion specified by the high temperature determination unit 71 arrives at a position to be cooled by the air cooler 63. The arrival time can be obtained by, for example, adding a numerical value corresponding to the interval between the radiation thermometer 62 and the nozzles 67 of the air cooler 63 to the value of the encoder 66 obtained when the above-described detection target portion is detected by the radiation thermometer 62.

After the hot portion is specified and when the time has reached the above-described arrival time, the cooler control unit 73 sets the nozzle 67 of the air cooler 63 in the cooling state. The nozzle 67 set in the cooling state is, of the plurality of nozzles 67, the nozzle 67 capable of cooling the hot portion detected by the radiation thermometer 62 and the high temperature determination unit 71.

When the nozzle 67 is set in the cooling state, the cooling air 68 is blown to the hot portion, and the hot portion is cooled.

In the thus configured printing apparatus 61, a sheet 4 is transferred by the printing cylinder 17 in a state in which the sheet 4 is heated to a predetermined temperature, and passes positions where the sheet faces first to fourth inkjet heads 27 to 30. When the sheet 4 faces each of the first to fourth inkjet heads 27 to 30, printing is performed on the sheet 4. At this time, if the application of the ink concentrates to one portion of the sheet 4, the temperature of this portion of the sheet 4 becomes higher than the temperatures of the remaining portions. The heat of the sheet 4 is transmitted to the transfer surface 24 of the printing cylinder 17 during transfer.

A hot portion may be formed on the transfer surface 24 because, for example, the ink concentrates to one portion of the sheet 4, and the temperature becomes too high.

In the printing apparatus 61 according to this embodiment, the radiation thermometer 62 and the air cooler 63 are provided between the receiving position P2 and the return position P3. For this reason, if a hot portion is formed on the transfer surface 24 of the printing cylinder 17, the position of the hot portion is specified in the rotating direction of the printing cylinder 17 by the radiation thermometer 62 and the control device 64, and the hot portion is cooled by the air cooler 63. When the hot portion is cooled in this way, the temperature of the transfer surface 24 (outer peripheral surface) of the printing cylinder 17 becomes constant. Hence, the temperature of the next sheet 4 held on the transfer surface 24 is appropriate all over the sheet 4, and printing can be performed with high quality. That is, this solves the problem that the surface temperature of a portion of the sheet 4 excessively rises, the viscosity of ink changes, and the image quality of the portion degrades.

Hence, in this embodiment as well, it is possible to provide the printing apparatus that cools the hot portion of the printing cylinder 17 and makes the image quality of a printing product high.

The radiation thermometer 62 and the high temperature determination unit 71 (hot portion detection means) according to this embodiment can individually detect temperatures at a plurality of positions of the transfer surface 24 (outer peripheral surface) in the axial direction of the printing cylinder 17. The air cooler 63 includes the plurality of nozzles 67 arranged in the axial direction of the printing cylinder 17. The nozzles 67 can be switched to the cooling state and the non-cooling state. Of the plurality of nozzles 67, the nozzle 67 capable of cooling the hot portion detected by the radiation thermometer 62 and the high temperature determination unit 71 is set in the cooling state at the arrival time.

For this reason, the position of the hot portion of the printing cylinder 17 is specified in both the rotating direction and the axial direction of the printing cylinder 17, and the hot portion is cooled by the nozzle 67 of the air cooler 63. Hence, according to this embodiment, only a portion of the printing cylinder 17, which needs to be cooled, is cooled, and the temperature becomes uniform all over the transfer surface 24 (outer peripheral surface) of the printing cylinder 17. It is therefore possible to provide the printing apparatus that further rises printing quality.

The printing apparatus 61 according to this embodiment includes a supply-side transfer cylinder 16 (sheet supply means) that supplies the sheet 4 to the printing cylinder 17 at a supply position P1. In addition, the printing apparatus 61 includes the transfer mechanism 18 that receives the sheet 4 after printing at the receiving position P2 located on the upstream side of the first to fourth inkjet heads 27 to 30 in the sheet transfer direction and transfers the sheet 4 to one of a discharge route 44 through which the sheet 4 is discharged and a reversing route 42 through which the sheet 4 is reversed. The transfer mechanism 18 employs an arrangement that returns the sheet 4 sent to the reversing route 42 and reversed to the printing cylinder 17 at the return position P3 located on the downstream side of the receiving position P2 in the sheet transfer direction and on the upstream side of the supply position P1 in the sheet transfer direction. The radiation thermometer 62 and the air cooler 63 are provided between the receiving position P2 and the return position P3.

The transfer surface 24 (outer peripheral surface) of the printing cylinder 17 is exposed between the receiving position P2 and the return position P3. For this reason, the temperature of the transfer surface 24 of the printing cylinder 17 can accurately be detected by the radiation thermometer 62. In addition, the transfer surface 24 of the printing cylinder 17 can directly be cooled by the air cooler 63.

Hence, according to this embodiment, since the position of the hot portion can be detected at high accuracy, and the hot portion can efficiently be cooled, cooling can be performed correctly and sufficiently.

The air cooler 63 according to this embodiment blows the cooling air 68 to the transfer surface 24 (outer peripheral surface) of the printing cylinder 17.

For this reason, the capability of cooling the transfer surface 24 of the printing cylinder 17 can easily be changed by changing the volume, direction, temperature, and the like of the cooling air 68. Hence, according to this embodiment, it is possible to provide the printing apparatus that can perform optimum cooling according to the operation state of the printing apparatus and stabilizes the quality of a printing product.

In the above-described embodiment, an example in which the air cooler 63 is used as a cooling means has been described. However, the present invention is not limited to this. As the cooling means, a means configured to spray a liquid such as water or alcohol to the transfer surface 24 and cool it by the heat of evaporation of the liquid may be used.

Third Embodiment

Figure 8:
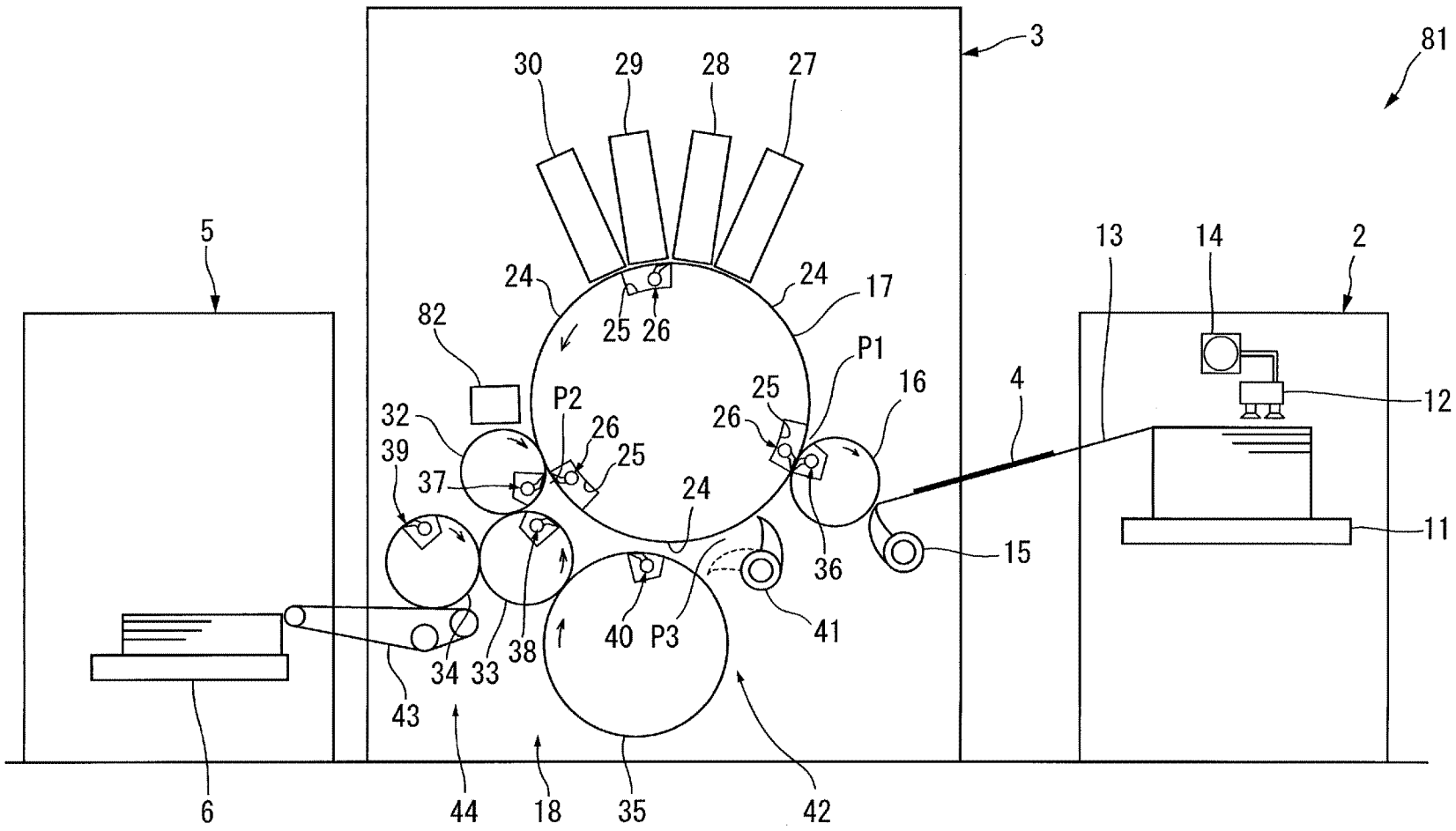
FIG. 8 is a side view showing the schematic arrangement of a printing apparatus according to the third embodiment of the present invention.
Figure 9:
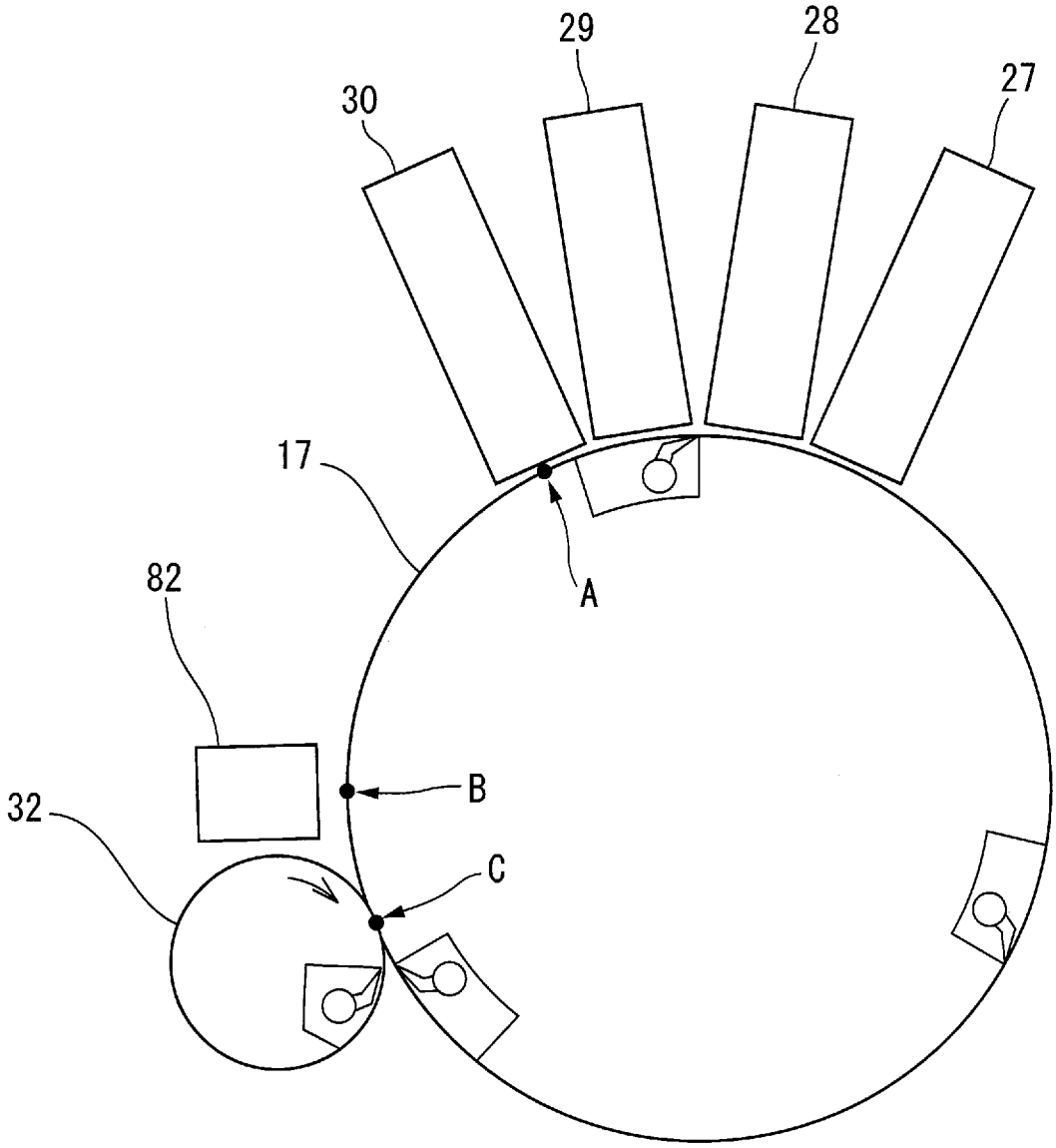
FIG. 9 is an enlarged side view showing main parts.

The printing apparatus according to the present invention can be configured as shown in FIGS. 8 and 9. Members that are the same as or similar to those described with reference to FIGS. 1 to 7 are denoted by the same reference numerals in FIGS. 8 and 9, and a detailed description thereof will appropriately be omitted.

A printing apparatus 81 shown in FIG. 8 is different from the printing apparatuses 1 and 61 shown in FIGS. 1 and 5 in an arrangement associated with cooling of a printing cylinder and an arrangement associated with application and solidification of ink, and the remaining arrangements are the same.

The printing apparatus 81 according to this embodiment does not include the cooling means 45 and the air cooler 63 shown in the first and second embodiments.

Ink used in each of first to fourth inkjet heads 27 to 30 according to this embodiment is of a UV curing type that is cured when irradiated with ultraviolet rays. The ink is ejected as ink droplets from each of the first to fourth inkjet heads 27 to 30 and adhered to a sheet 4. At the beginning of application, the shape of the ink adhered to the sheet is an almost semispherical shape projecting from the sheet surface. When a predetermined time elapses, the projecting portion becomes gentle and changes into a shape conforming to the sheet surface.

In the transfer direction of the sheet 4, a drying device 82 is provided near a first discharge-side transfer cylinder 32 and between the fourth inkjet head 30 and the first discharge-side transfer cylinder 32. The drying device 82 irradiates the sheet 4 with ultraviolet rays and faces a printing cylinder 17 while being spaced apart from the printing cylinder 17 by a predetermined distance. In this embodiment, the first to fourth inkjet heads 27 to 30 correspond to "printhead" in the invention described in claim 5, the drying device 82 corresponds to "drying device" in the invention described in claim 5, and the first discharge-side transfer cylinder 32 corresponds to "discharge cylinder" in the invention described in claim 5.

When the drying device 82 is arranged near the first discharge-side transfer cylinder 32, the holding time in which the sheet 4 is held by the printing cylinder 17 after the drying (solidification) of the ink is shortest. The ink generates heat by a chemical reaction. The heat of the ink is transmitted to the printing cylinder 17 via the sheet 4. In this embodiment, however, since the time in which the sheet 4 is held by the printing cylinder 17 after the drying of the ink is short, the heat generated in association with the ink drying processing is hardly transmitted to the printing cylinder 17.

Additionally, when the drying device 82 is arranged in this way, the ink is smoothened after application to the sheet 4 and dried in a state in which the ink is fixed to the sheet 4. The ink smoothening here means the shape change of the ink surface in which a projection formed by each ink droplet adhered to the sheet 4 becomes gentle, and the ink surface conforms to the sheet without any mixture of ink droplets that are adjacent to each other.

If the ink is dried before smoothening, an unevenness readily occurs in the image portion of the sheet 4 because the ink is in the state of projections formed from ink droplets. In this case, the gloss extremely lowers, or the ink itself reflects light and unnaturally shines, and the gloss of the sheet 4 becomes uneven.

In addition, if the time from the smoothening to the drying of the ink becomes long, each ink droplet spreads too much and mixes with an adjacent ink droplet, resulting in degradation in image quality.

The placing position of the drying device 82 that satisfies the conditions that the ink is smoothened, and the above-described holding time shortens can be defined based on the transfer distance of the sheet 4 after printing. The placing position of the drying device 82 according to this embodiment is a position where a transfer distance AB between a printing end position A and a drying position B becomes longer than a transfer distance BC between the drying position B and a handover position C, as shown in FIG. 9.

The printing end position A is a position where printing is performed on the sheet 4 by the fourth inkjet head 30.

The drying position B is a position where the ink is dried by the drying device 82.

The handover position C is a position where the sheet 4 is handed over from the printing cylinder 17 to the first discharge-side transfer cylinder 32.

When the drying device 82 is arranged at this position, the heat generated by the ink drying processing is hardly transmitted to the printing cylinder 17. For this reason, in this embodiment, an increase in the temperature of the transfer surface of the printing cylinder 17 can be suppressed without using a device for cooling the printing cylinder 17. Hence, in this embodiment as well, it is possible to provide the printing apparatus that always sets the temperature of the sheet at an appropriate temperature. Additionally, according to this embodiment, since the ink is dried in a smoothened state, it is possible to provide the printing apparatus that makes printing quality higher.

EXPLANATION OF THE REFERENCE NUMERALS AND SIGNS

1, 61, 81 . . . printing apparatus, 4 . . . sheet, 16 . . . supply-side transfer cylinder, 17 . . . printing cylinder, 18 . . . transfer mechanism, 24 . . . transfer surface, 27 . . . first inkjet head, 28 . . . second inkjet head, 29 . . . third inkjet head, 30 . . . fourth inkjet head, 32 . . . first discharge-side transfer cylinder, 42 . . . reversing route, 44 . . . discharge route, 45 . . . cooling means, 46 . . . cooling air, 47 . . . fan, 62 . . . radiation thermometer, 63 . . . air cooler, 64 . . . control device, 67 . . . nozzle, 68 . . . cooling air, 82 . . . drying device, P2 . . . receiving position, P1 . . . supply position, P3 . . . return position.

The invention claimed is:

1. A printing apparatus comprising:

a printing cylinder which holds a sheet on an outer peripheral surface and rotationally transfers the sheet in a predetermined direction;

sheet supply means for supplying the sheet to the printing cylinder at a predetermined supply position;

a printhead which discharges ink toward the sheet held by the printing cylinder and performs printing on the sheet; and a transfer mechanism which receives the sheet after the printing at a receiving position located on a downstream side of the printhead in a sheet transfer direction, transfers the sheet to one of a discharge route through which the sheet is discharged and a reversing route through which the sheet is reversed, and returns the sheet, which is sent to the reversing route and reversed, to the printing cylinder at a return position located on the downstream side of the receiving position in the sheet transfer direction and on an upstream side of the supply position in the sheet transfer direction;

cooling means, provided between the receiving position and the return position, for cooling the outer peripheral surface of the printing cylinder;

hot portion detection means, provided on the upstream side of the cooling means in a rotation direction of the printing cylinder, for detecting a hot portion of the outer peripheral surface where a temperature is high;

phase detection means for detecting a rotation phase of the printing cylinder; and a control device which control an operation of the cooling means, wherein the cooling means is switchable to a cooling state to cool the outer peripheral surface of the printing cylinder and a non-cooling state not to cool the outer peripheral surface, and the control device performs switching based on the hot portion detection means and the phase detection means such that the cooling means is set in the cooling state at a position where the cooling means faces the hot portion, and the cooling means is set in the non-cooling state at a position where the cooling means does not face the hot portion.

2. The printing apparatus according to claim 1, wherein the cooling means includes a plurality of cooling units arranged in an axial direction of the printing cylinder, and the control device sets, of the plurality of cooling units, a cooling unit corresponding to the hot portion in the axial direction, which is detected by the hot portion detection means, in the cooling state.

3. The printing apparatus according to claim 2, wherein the hot portion detection means includes a plurality of detection units capable of respectively detecting temperatures at a plurality of positions of the outer peripheral surface in the axial direction of the printing cylinder, the plurality of cooling units are provided at positions in the axial direction equal to positions of the plurality of detection units, respectively, and the control device sets, in the cooling state, the cooling unit at a position in the axial direction equal to a position of the detection unit which detects the hot portion.

4. A printing apparatus comprising:

a printing cylinder which holds a sheet on an outer peripheral surface and rotationally transfers the sheet in a predetermined direction;

a plurality of printheads each of which discharges ink of a UV curing type toward the sheet held by the printing cylinder and performs printing on the sheet;

a discharge cylinder to which the sheet printed by the plurality of printheads and transferred by the printing cylinder is handed over and which holds the sheet on an outer peripheral surface and rotationally discharges the sheet in a predetermined direction; and a drying device located between the plurality of printheads and the discharge cylinder in a sheet transfer direction and arranged facing the printing cylinder and configured to radiate the sheet with ultraviolet rays, wherein the drying device is located only in a position where a transfer distance between a printing end position and a drying position is longer than a transfer distance between the drying position and a handover position, wherein the printing end position is a position where printing is performed on the sheet by a printhead located on the most downstream side in the sheet transfer direction among the plurality of printheads, wherein the drying position is a position where the ink is dried by the drying device, and wherein the handover position is a position where the sheet is handed over from the printing cylinder to the discharge cylinder.

* * * * *